United States Patent [19]

Grass et al.

[11] Patent Number: 4,465,567

[45] Date of Patent: Aug. 14, 1984

[54] PROCESS FOR THE MANUFACTURE OF 3-HYDROXY-2-CYCLOALKEN-1-ONE DERIVATIVES

[75] Inventors: Hansjörg Grass, Muttenz; Erich Widmer, Münchenstein, both of Switzerland

[73] Assignee: Hoffmann-La Roche Inc., Nutley, N.J.

[21] Appl. No.: 461,092

[22] Filed: Jan. 26, 1983

[51] Int. Cl.[3] ..... C25B 3/00

[52] U.S. Cl. ..... 204/75; 204/59 R

[58] Field of Search ..... 204/59 R, 75, 76, 77

[56] References Cited

U.S. PATENT DOCUMENTS

| | | | |
|---|---|---|---|
| 4,153,805 | 5/1979 | Rosenberger | 560/240 |
| 4,323,711 | 4/1982 | Lukac et al. | 568/347 |
| 4,414,079 | 11/1983 | Yamataka | 204/75 |

OTHER PUBLICATIONS

E. Widmer et al., Helv. Chim. Acta 64, 2436, (1981).

L. De Buyck et al., Bull. Soc. Chim. Belg. 90, 837, (1981).

H. Doupeux et al., Electrochimica Acta 19, 629, (1974).

*Primary Examiner*—John F. Niebling

*Attorney, Agent, or Firm*—Jon S. Saxe; Bernard S. Leon; Alan R. Stempel

[57] ABSTRACT

A process for the manufacture of 3-hydroxy-2-cycloalken-1-one derivatives by cathodically reducing a compound of the general formula

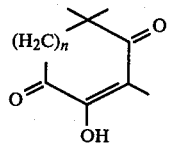

I wherein n is the integer 0 or 1, to a compound of the formula

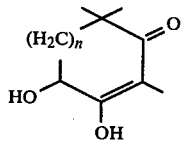

II wherein n has the above significance, and, if desired, further cathodically reducing the resulting compound in acidic or neutral medium to a compound of the general formula

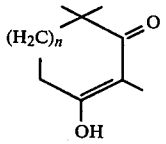

III wherein n has the above significance.

17 Claims, No Drawings

PROCESS FOR THE MANUFACTURE OF 3-HYDROXY-2-CYCLOALKEN-1-ONE DERIVATIVES

BRIEF SUMMARY OF THE INVENTION

The present invention is concerned with the manufacture of intermediates in carotenoid syntheses. More particularly, the invention is concerned with the manufacture of 3-hydroxy-2-cycloalken-1-one derivatives.

DETAILED DESCRIPTION OF THE INVENTION

The process provided by the invention comprises cathodically reducing a compound of the formula

I

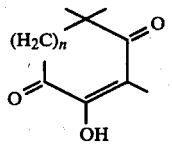

wherein n is the integer 0 or 1, to a compound of the formula

II

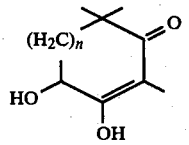

wherein n is as described above, and, if desired, further cathodically reducing the resulting compound in an acidic or neutral medium to a compound of the formula

III

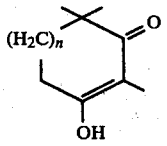

wherein n remains as described above.

The reduction of the compound of formula I above in which n is the integer 1 to the corresponding compound of formula III by means of zinc and a carboxylic acid is known from European Patent Publication No. 0031875. However, this process has the disadvantage that it must be carried out with an excess of zinc and therefore large amounts of zinc salts result.

It has now been found that the process provided by the present invention is devoid of the disadvantages of the previously known process and yet enables the desired products to be obtained in good yield. Since the potentials required for the reduction of the compounds of formulae I and II are sufficiently different, either compounds of formula II or compounds of formula III can be obtained selectively according to the present process. Moreover, the process provided by the present invention can be carried out readily as a continuous process.

The compound of formula II above in which n is the integer 0, that is, the compound of the formula IIa

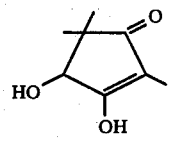

is novel and also forms an object of the invention.

The compounds of formulae II and III above can exist in tautomeric forms and are, therefore, obtained according to the process provided by the invention as the corresponding tautomeric mixture:

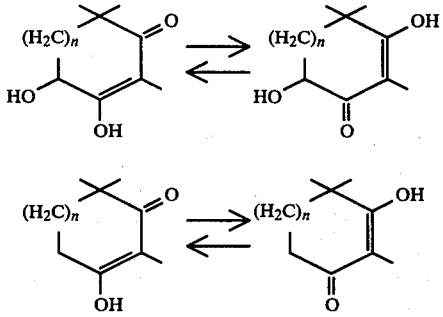

The tautomeric 1,3-diketone is occasionally quoted in the literature for such compounds. However, it has been found that the compounds of formulae II and III exist practically exclusively in the above keto-enol forms.

The process provided by the invention can be carried out in undivided or subdivided cells. However, a subdivided cell is preferably used, wherein the subdivision can be carried out with membranes or diaphragms of usual membrane or diaphragm materials such as clay, ceramics, glass (for example, a glass sinter diaphragm) or polymeric compounds (for example, a NAFION® membrane, manufactured by Dupont).

The electrodes can have usual forms. For example, the electrodes can be constructed in the form of plates or lattices or as expanded metal.

Mercury, for example, as a mercury sump electrode, lead and graphite are preferred cathode materials. However, depending on the reaction conditions other cathode materials can also be used. For example, in strongly acidic solutions cadmium, zinc, aluminum, steel or copper gauze coated with lead may be used. Cadmium, zinc or tin are useful in weakly acidic or neutral solutions and nickel is useful in basic solutions. Further, nickel, copper, steel, vanadium, silver, cobalt, brass and the like can also be used for the reduction of a compound of formula I to the corresponding compound of formula II in acidic solutions.

The anode materials used in the process provided by the invention are not critical. Suitable anode materials are, for example, platinum, palladium, silver, gold, graphite or lead. Further, dimensionally stable anodes, such as, for example, those mentioned in A. Schmidt, Angewandte Elektrochemie, p. 70, Verlag Chemie (1976), also called metal oxide composite anodes, can be used. Such anodes consist of a carrier of titanium, iron, nickel or the like which is provided with a metal oxide coating (e.g. lead dioxide, manganese dioxide, ruthenium dioxide or titanium suboxide), wherein an intermediate layer of a carbide or boride of the elements of the IVth and Vth subgroup is applied to the metal surface before the application of the metal oxide coating.

The electrolysis in accordance with the invention is carried out with an acidic or neutral reaction medium which includes an electrolyte, an inert organic solvent (co-solvent) and the compound of formula I used as the starting material.

As electrolytes there can be used, for example, aqueous acids such as sulfuric acid, hydrofluoric acid, hydrochloric acid, phosphoric acid, perchloric acid, aqueous trifluoroacetic acid and the like. Mineral acids, especially sulfuric acid, have been found to be especially suitable. There are preferably used about 0.1N to about 18N, and most preferably about 1N to about 10N, aqueous acids.

As co-solvents there can be used inert organic solvents which are miscible with water or immiscible with water. When a co-solvent which is not miscible with water, for example 1,2-dichloroethane or carbon tetrachloride is used, a phase transfer catalyst, preferably a tetraalkylammonium salt such as tetrabutylammonium hydrogen sulfate, is preferably added.

However, there is preferably used a co-solvent which is miscible with water, for example an alcohol such as methanol, ethanol or t-butanol, a cyclic ether such as tetrahydrofuran or 1,4-dioxane, a nitrile such as acetonitrile, an amide such as N,N-dimethylformamide or hexamethylphosphoric acid triamide, a carboxylic acid such as formic acid or acetic acid, or propylene carbonate, dimethyl sulphoxide or acetone. Methanol, ethanol, t-butanol, tetrahydrofuran and 1,4-dioxane are preferred among such solvents.

When a carboxylic acid is used as the co-solvent, it is most convenient to use an aqueous solution of a carboxylate, for example, sodium formate or sodium acetate, as the electrolyte. It is also possible to use an aqueous solution of a carboxylic acid, such as formic acid as the electrolyte. In this case, however, in order to improve the conductivity, there is preferably added a conducting salt, for example, sodium formate and as the co-solvent there is used, for example, an alcohol such as methanol.

The volumetric ratio of electrolyte to co-solvent is preferably about 5:1 to about 1:5 and most preferably about 1:1 when a co-solvent which is miscible with water is used. On the other hand, when a co-solvent which is not miscible with water is used there is generally added only sufficient co-solvent as is necessary to guarantee a sufficient solubility of the educt and of the product.

Furthermore, an aqueous solution of a base, for example, about 0.1N–5N sodium hydroxide or potassium hydroxide, can also be used as the electrolyte. Since educt and product are sufficiently soluble in such electrolytes, the use of a co-solvent is unnecessary. The potentials required for the reduction are, however, more negative in basic reaction media than in acidic or neutral media. While the reduction of the compounds of formula I to compounds of formula II in basic solutions is possible without problems, it is, in general, not possible in such media to reduce the compounds of formula II further to compounds of formula III, since with the negative potentials required for this, decomposition of the solvent occurs.

The reduction of the compounds of formula II is therefore preferably carried out in an acidic or neutral reaction medium. Such reaction media are, however, also preferred for the reduction of the compounds of formula I to the compounds of formula II. Acidic reaction media are especially preferred.

In the reduction of the compound of formula II in which n is zero, it has been found to be convenient to add to the reaction mixture a phase transfer catalyst, for example, a tetraalkylammonium salt such as tetramethylammonium tetrafluoroborate, tetraethylammonium tosylate, tetraethylammonium perchlorate, tetrabutylammonium perchlorate, tetrabutylammonium tetrafluoroborate, tetrabutylammonium bromide, tetrakis-decylammonium perchlorate, hexadecyl-trimethylammonium bromide or, preferably, tetrabutylammonium bromide. The concentration of the phase transfer catalyst is preferably about 0.05 mol/l to about 0.8 mol/l based on the total mixture.

The concentration (weight/volume) of the starting material in the reaction mixture used can vary in general between about 0.3% and 15% and is preferably between about 5% and 15% in the case of the compounds of formulae I and II in which n is 0. In the case of the compounds of formulae I and II in which n is 1, it is preferably about 0.3% to about 10% and most preferably about 5%.

The temperature at which the process of the invention is carried out is not critical. There is, however, an upper limit set by the boiling point of the reaction mixture. It is preferably carried out between room temperature and about 65° C. The reaction can be carried out in the presence or absence of a protective gas. However, it is preferably carried out under an inert gas such as, for example, nitrogen or argon.

The process provided by the invention can be carried out galvanostatically or potentiostatically. The potentiostatic process is preferred.

The requisite potential depends on the reaction mixture and cathode material used and can be determined by measuring the current-potential curves, for example by cyclic voltammetry. For the manufacture of a compound of formula III from the corresponding compound of formula I the intermediate product of formula II need not be isolated from the reaction mixture, and, therefore, the compound of formula I can be reduced directly to the compound of formula III by the application of an appropriate negative potential. The following examples are intended to give an indication of the magnitude of the potentials to be used:

(a) for the reduction of the compound of formula I in which n is 1 to the corresponding compound of formula II, there is preferably used, with a lead cathode in 10N sulfuric acid/dioxane (1:1), a potential of about −750 mV (against a saturated calomel electrode SCE) and, with a nickel cathode in 2N sodium hydroxide, a potential of about −1300 mV (against SCE).

(b) For the reduction of the compound of formula I or II in which n is 1 to the corresponding compound of formula III there is preferably used, with a lead cathode in 1N sulfuric acid/ethanol (1:1), a potential of about −1200 mV (against SCE).

(c) For the reduction of the compound of formula I in which n is 0 to the corresponding compound of formula II there is preferably used, with a mercury sump cathode in 3N sulfuric acid/dioxane (1:1), a potential of about −650 mV (against a saturated silver/silver chloride electrode SSE) and, in 3N sodium hydroxide, a potential of about −1500 mV (against SCE).

(d) For the reduction of the compound of formula I or II in which n is 0 to the corresponding compound of formula III there is preferably used, with a mercury sump cathode in 3N sulfuric acid/dioxane (1:1) and the addition of tetrabutylammonium hydrogen sulfate, a potential of about −1200 mV (against SSE).

The current density used in the process provided by the invention is not critical. In general, for the 5-ring compounds (n=0) it can vary between about 4 and 70 $mA/cm^2$ and for the 6-ring compound (n=1) it can vary between about 4 and 40 $mA/cm^2$.

Voltage and amperage depend on the reaction medium used, the size of the cell, the current density used and the like.

The conversion of the compounds obtained in accordance with the present invention into carotenoids is known to persons skilled in the art. For example, the conversion of the compounds for formula III into canthaxanthin or dinorcanthaxanthin is described in Pure and Appl. Chem. 51, 871–886.

The Examples which follow further illustrate the process of the invention:

EXAMPLE 1

A glass vessel (H cell) divided into two is used as the reaction vessel. The anode compartment is separated from the cathode compartment by a round glass sinter diaphragm (diameter: 3.5 cm). A square lead sheet (5 cm×5 cm) and a saturated calomel reference electrode (SCE) are present in the cathode compartment. A platinum wire is used as the anode. Both electrode compartments are provided with a gas inlet tube and the cathode compartment is provided with a magnetic stirrer. While stirring and introducing argon gas, 140 ml of dioxane and 140 ml of 10N aqueous sulfuric acid are added to the cathode compartment and 80 ml of dioxane and 80 ml of 10N aqueous sulfuric acid are added to the anode compartment. After 16.8 g of the initially incompletely dissolved 2-hydroxy-3,5,5-trimethyl-2-cyclohexene-1,4-dione have been added to the cathode compartment, the mixture is electrolyzed at room temperature at a constant cathode potential of −1150 mV (aganst SCE) while stirring and introducing argon gas, whereupon an amperage of about 750 mA and a cell potential of about 13 V develop. After 41500 Coulombs, which corresponds to 108% of the theoretically required amount of current, have flowed through the cell, the electrolysis is interrupted. The catholyte solution is added to a 2 liter separating funnel $S_1$ with 1000 ml of water (deionized). Two further 2 liter separating funnels $S_2$ and $S_3$ are each charged with 500 ml of 15 percent (W/V) sodium chloride solution. Three 500 ml portions of methylene chloride are passed in succession through the three separating funnels $S_1$–$S_3$. The organic phases are dried over 50 g of sodium sulfate and filtered. The combined filtrates are concentrated to constant weight in a rotary evaporator under a water-jet vacuum at 40° C. (bath temperature). There are obtained 16.0 g of a white-yellow crystalline residue which contains, as determined by gas chromatography, 12.9 g (84%) of a product which is a tautomeric mixture of 3-hydroxy-2,6,6-trimethyl-2-cyclohexen-1-one and, 3-hydroxy-2,4,4-trimethyl-2-cyclohexen-1-one. The crude product is subsequently dissolved in 45 ml of hot diisopropyl ether. White crystals separate after cooling to room temperature. The mixture is then left to stand at −20° C. overnight; the crystals are filtered off under suction and washed twice with 20 ml of diisopropyl ether (cooled to −20° C.) and dried to constant weight at 40° C. under a water-jet vacuum. There are obtained 12.0 g (78%) of pure product of melting point 114°–116°.

EXAMPLE 2

(a) A glass vessel (H cell) divided into two is used as the reaction vessel. The anode compartment is separated from the cathode compartment by a round glass sinter diaphragm (diameter: 3.5 cm). A square lead sheet (5 cm×5 cm) and a saturated calomel reference electrode (SCE) are present in the cathode compartment. A square lead sheet (3.5 cm×3.5 cm) is also used as the anode. Both electrode compartments are provided with a gas inlet tube and the cathode compartment is provided with a magnetic stirrer. While stirring and introducing nitrogen, 160 ml of dioxane and 160 ml of 10N aqueous sulfuric acid are added to the cathode compartment and 90 ml of dioxane and 90 ml of 10N aqueous sulfuric acid are added to the anode compartment. After 16.8 g of the initially incompletely dissolved 2-hydroxy-3,5,5-trimethyl-2-cyclohexene-1,4-dione have been added to the cathode compartment, the mixture is electrolyzed at room temperature at a constant cathode potential of −750 mV (against SCE) while stirring and introducing nitrogen, whereupon an amperage of about 500 mA develops. After 19500 Coulombs have flowed through the cell, which corresponds to 101% of the theoretically required amount of current, and the amperage has dropped to 3 mA, the electrolysis is interrupted. The catholyte solution is added to a 2 liter separating funnel $S_1$ with 500 ml of water (deionized). Two additional 1 liter separating funnels $S_2$ and $S_3$ are each charged with 500 ml of 15 percent sodium chloride solution. Nine 300 ml portions of methylene chloride are passed in succession through the three separating funnels $S_1$–$S_3$. The organic phases are dried over 50 g of sodium sulfate and filtered. The combined filtrates are concentrated up to constant weight in a rotary evaporator under a water-jet vacuum at 40° C. (bath temperature). There are obtained 19.1 g of a yellow resin which contains, according to gas chromatography, 15.8 g (93%) of a product which is a tautomer mixture of 3,4-dihydroxy-2,6,6-trimethyl-2-cyclohexen-1-one and 3,6-dihydroxy-2,4,4-trimethyl-2-cyclohexen-1-one. The crude product is dissolved in 40 ml of hot diisopropyl ether. The first crystals separate after cooling to room temperature. Thereafter, the mixture is left to stand at −20° C. overnight, the crystals are filtered off under suction and washed twice with in each case 20 ml of hexane (cooled to −20° C.) and dried to constant weight at 50° C. under a water-jet vacuum. There are obtained 15.2 g (89%) of pure product of melting point 107° C.

(b) For the further reduction, 17.0 g of the product obtained in paragraph (a) are electrolyzed at a constant cathode potential of −1150 mV (against SCE). The remaining experimental conditions require no alteration. After the amperage has dropped from initially 500 mA to 30 mA and 24300 Coulomb, which corresponds to 126% of the theoretically required amount of current, have flowed through the cell, the electrolysis is interrupted. The catholyte solution is added to a 2 liter separating funnel $S_1$ with 500 ml of water (deionized). Two additional 1 liter separating funnels $S_2$ and $S_3$ are each charged with 500 ml of 15 percent sodium chloride solution. Five 300 ml portions of methylene chloride are passed in succession through the three separating funnels $S_1$–$S_3$. The organic phases are dried over 50 g of sodium sulfate and filtered. The combined filtrates are concentrated in a rotary evaporator under a water-jet vacuum at 40° C. (bath temperature). There are obtained 19.3 g of a yellow crystalline residue which contains, according to gas chromatography, 13.3 g (86%) of a product which is a tautomer mixture of 3-hydroxy-2,6,6-trimethyl-2-cyclohexen-1-one and 3-hydroxy-2,4,4-trimethyl-2-cyclohexen-1-one. The crude product is subsequently dissolved in 35 ml of hot diisopropyl ether. The first white crystals separate after cooling to room temperature. Thereafter, the mixture is left to stand at −20° C. overnight, the crystals are filtered off under suction and washed twice with in each case 20 ml of hexane (cooled to −20° C.) and dried up to constant weight at 50° C. under a water-jet vacuum. There are obtained 12.8 g (83%) of pure product of melting point 116°-117° C.

EXAMPLE 3

A glass vessel (H cell) divided into two is used as the reaction vessel. The anode compartment is separated from the cathode compartment by a round glass sinter diaphragm (diameter: 3.5 cm). A square nickel sheet (5 cm×5 cm) and a saturated claomel reference electrode (SCE) are present in the cathode compartment. A square lead sheet (3.5 cm×3.5 cm) is used as the anode. Both electrode compartments are provided with a gas inlet tube and the cathode compartment is provided with a magnetic stirrer. While stirring and introducing nitrogen, 320 ml of 2N aqueous sodium hydroxide and 16.8 g of 2-hydroxy-3,5,5-trimethyl-2-cyclohexene-1,4-dione are added to the cathode compartment and 180 ml of 2N aqueous sodium hydroxide are added to the anode compartment. Subsequently, the mixture is electrolyzed at room temperature at a constant cathode potential of −1300 mV (against SCE). After the amperage has dropped from 300 mA to 10 mA and 21200 Coulombs, which corresponds to 110% of the theoretically required amount of current, have flowed through the cell, the electrolysis is stopped. The catholyte solution is acidified with 500 ml of 3N aqueous sulfuric acid in a 2 liter separating funnel $S_1$. Two additional separating funnels $S_2$ and $S_3$ are each charged with 400 ml of 15 percent sodium chloride solution. Nine 200 ml portions of methylene chloride are passed in succession through the three separating funnels $S_1$-$S_3$. The organic phases are dried over 50 g of sodium sulfate and filtered. The combined filtrates are concentrated to constant weight in a rotary evaporator under a water-jet vacuum at 40° C. (bath temperature). There are obtained 17.0 g of a rose colored crystalline residue which contains, according to gas chromatographical analysis, 13.1 g (77%) of a product which is a tautomer mixture of 3,4-dihydroxy-2,6,6-trimethyl-2-cyclohexen-1-one and 3,6-dihydroxy-2,4,4-trimethyl-2-cyclohexen-1-one. The crude product is dissolved in 40 ml of hot diisopropyl ether. The first crystals separate after cooling to room temperature. Thereafter, the mixture is left to stand at −20° C. overnight, the crystals are filtered off under suction and washed twice with 20 ml of hexane (cooled to −20° C.) and dried to constant weight at 40° C. under a water-jet vacuum. There are obtained 12.7 g (75%) of pure product of melting point 104°-105° C.

EXAMPLE 4

A thermostatizable glass vessel (H cell) divided into two is used as the reaction vessel. The anode compartment is separated from the cathode compartment by a replaceable NAFION® membrane (Dupont) having a diameter of 4 cm. A mercury sump electrode (surface: about 12.5 $cm^2$) is present in the cathode compartment. A platinum sheet (2.5 cm×2.5 cm) is used as the anode. Both electrode compartments are provided with a gas inlet tube and the cathode compartment is provided with a magnetic stirrer and thermometer. While stirring and introducing argon gas, 50 ml of dioxane, 50 ml of 3N aqueous sulfuric acid, 3.4 g of tetrabutylammonium hydrogen sulfate and 15.0 g of 4-hydroxy-2,2,5-trimethyl-4-cyclopentene-1,3-dione are added to the cathode compartment and 50 ml of dioxane and 50 ml of 3N aqueous sulfuric acid are added to the anode compartment. As soon as the solution has been brought to a constant temperature of 65° C., it is electrolyzed at a constant amperage of 100 mA while stirring and gassing with argon, so that a cell potential of about 3.5 V develops. After 44,600 Coulombs, which corresponds to 119% of the theoretically required amount of current, have flowed through the cell, the electrolysis is stopped. The catholyte solution is added to a 500 ml separating funnel $S_1$ with 200 ml of 15 percent sodium chloride solution. Two additional 500 ml separating funnels $S_2$ and $S_3$ are each charged with 400 ml of 15 percent sodium chloride solution. Nine 150 ml portions of methylene chloride are passed in succession through the three separating funnels $S_1$-$S_3$. The organic phases are dried over 20 g of sodium sulfate and filtered. The combined filtrates are concentrated to constant weight in a rotary evaporator under a water-jet vacuum at 40° C. (bath temperature). There are obtained 21.3 g of a yellowish, crystalline residue which is purified on a chromatography column loaded with 100 g of silica gel. Five (5) 1 of diethyl ether are used as the eluant. The pure fractions are combined and concentrated to constant weight under a water-jet vacuum at 40° C. (bath temperature). There are obtained 11.0 g of a yellowish, crystalline residue which is dissolved in a hot mixture of 50 ml of diisopropyl ether and 50 ml of acetone. The first white crystals separate after cooling to room temperature. Thereafter, the mixture is left to stand at −20° C. overnight, the crystals are filtered off under suction and washed twice with in each case 20 ml of diisopropyl ether (cooled to −20° C.) and dried up to constant weight at 50° C. under a water-jet vacuum. There are obtained 9.6 g (70%) of a product of melting point 170° C. which is a tautomer mixture of 3-hydroxy-2,5,5-trimethyl-2-cyclopenten-1-one and 3-hydroxy-2,4,4-trimethyl-2-cyclopenten-1-one.

EXAMPLE 5

(a) A glass vessel (H cell) divided into two is used as the reaction vessel. The anode compartment is separated from the cathode compartment by a round glass sinter diaphragm (diameter: 3.5 cm). A mercury sump electrode (surface: about 28 $cm^2$) and a saturated silver/silver chloride reference electrode (SSE) are present in the cathode compartment. A lead sheet (3.5 cm×3.5 cm) is used as the anode. Both electrode compartments are provided with a gas inlet tube and the cathode compartment is provided with a magnetic stirrer. While stirring and introducing nitrogen gas, 160 ml of dioxane and 160 ml of 3N aqueous sulfuric acid are added to the cathode compartment and 90 ml of dioxane and 90 ml of 3N aqueous sulfuric acid are added to the anode compartment. After 15.4 g of the initially incompletely dissolved 4-hydroxy-2,2,5-trimethyl-4-cyclopentene-1,3-dione have been added to the cathode compartment, the mixture is electrolyzed at room temperature at a cathode potential of −650 mV (against SSE) while stirring and introducing nitrogen, whereupon an amperage of about 200 mA sets in. After the amperage has dropped to 5 mA and 19,300 Coulomb, which corresponds to 100% of the theoretically required amount of current, have flowed through the cell, the electrolysis is interrupted. The combined catholyte and anolyte solutions are added to a 2 liter separating funnel $S_1$ with 500 ml of saturated sodium chloride solution. Two additional 1 liter separating funnels $S_2$ and $S_3$ are each charged with 200 ml of sodium chloride solution. One 300 ml portion of methylene chloride and nine 100 ml portions of methylene chloride are passed in succession through the three separating funnels $S_1$–$S_3$. The organic phases are dried over 50 g of sodium sulfate and filtered. The combined filtrates are concentrated up to constant weight in a rotary evaporator under a water-jet vacuum at 40° C. (bath temperature). 17.6 g of white crystals are obtained. The crude product is dissolved in a hot mixture of 50 ml of diisopropyl ether and 50 ml of acetone. The first white crystals separate after cooling to room temperature. Thereafter, the mixture is left to stand at −20° C. overnight, the crystals are filtered off under suction and washed twice with in each case 20 ml of diisopropyl ether (cooled to −20° C.) and dried up to constant weight at 50° C. under a water-jet vacuum. There are obtained 9.5 g (61%) of a product of melting point of 147°–148° C. which is a tautomer mixture of 3,4-dihydroxy-2,5,5-trimethyl-2-cyclopenten-1-one and 3,5-dihydroxy-2,4,4-trimethyl-2-cyclopenten-1-one.

(b) For the further reduction at a cathode potential of −1200 mV (against SSE), there are added to the cathode compartment, besides 45 ml of dioxane, 45 ml of 3N aqueous sulfuric, acid and 3.05 g of tetrabutylammonium hydrogen sulfate 15.6 g of the product obtained in paragraph (a). The anode compartment, which contains 50 ml of dioxane and 50 ml of 3N aqueous sulfuric acid as well as a platinum wire anode, is separated from the cathode compartment by a round polymer membrane (diameter: 4 cm). The remaining experimental conditions require to alteration. After the amperage has dropped from initially 150 mA to 70 mA and 27,100 Coulomb, which corresponds to 140% of the theoretically required amount of current, have flowed through the cell, the electrolysis is interrupted. The catholyte solution is added to a 500 ml separating funnel $S_1$ with 150 ml of saturated sodium chloride solution. Two additional 500 ml separating funnels $S_2$ and $S_3$ are each charged with 150 ml of saturated sodium chloride solution. Nine 150 ml portions of methylene chloride are passed in succession through the three separating funnels $S_1$–$S_3$. The organic phases are dried over 50 g of sodium sulfate and filtered. The combined filtrates are concentrated up to constant weight in a rotary evaporator under a water-jet vacuum at 40° C. (bath temperature). There are obtained 14.9 g of a yellow crystalline residue which, after purification (separation of the polar tetrabutylammonium hydrogen sulfate) on a chromatography column (silica gel/diethyl ether), give 11.9 g of white-yellow crystals. After recrystallization from a mixture of 50 ml of diisopropyl ether and 50 ml of acetone, there are obtained 9.9 g (71%) of a product of melting point of 169°–179° C. which is a tautomer mixture of 3-hydroxy-2,5,5-trimethyl-2-cyclopenten-1-one and 3-hydroxy-2,4,4-trimethyl-2-cyclopenten-1-one.

EXAMPLE 6

A glass vessel (H cell) divided into two is used as the reaction vessel. The anode compartment is separated from the cathode compartment by a round glass sinter diaphragm (diameter: 2.5 cm). A graphite electrode (3.5 cm×3.5 cm) and a saturated silver/silver chloride reference electrode (SSE) are present in the cathode compartment. A titanium anode coated with lead dioxide is used as the anode. Both electrode compartments are provided with a gas inlet tube and the cathode compartment is provided with a magnetic stirrer. While stirring and introducing argon gas, 35 ml of ethanol and 35 ml of 1N aqueous sulfuric acid are added to the cathode compartment and 35 ml of ethanol and 35 ml of 1N aqueous sulfuric acid are added to the anode compartment. After 0.7 g of 2-hydroxy-3,5,5-trimethyl-2-cyclohexene-1,4-dione has been added to the cathode compartment, the mixture is electrolyzed at room temperature at a constant cathode potential of −1250 mV (against SSE) while stirring and introducing argon gas, whereupon an amperage of about 306 mA sets in. After 2600 Coulomb, which corresponds to 162% of the theoretically required amount of current, have flowed through the cell, the electrolysis is interrupted. The catholyte solution is extracted five times with 50 ml of chloroform each time. The combined extracts are dried over sodium sulfate, filtered and concentrated. The concentrated solution contains, in accordance with gas chromatographical analysis, 0.45 g (70%) of the tautomer mixture of 3-hydroxy-2,6,6-trimethyl-2-cyclohexen-1-one and 3-hydroxy-2,4,4-trimethyl-2-cyclohexen-1-one and 0.022 g (3%) of the tautomer mixture of 3,4-dihydroxy-2,6,6-trimethyl-2-cyclohexen-1-one and 3,6-dihydroxy-2,4,4-trimethyl-2-cyclohexen-1-one.

We claim:

1. A process for the manufacture of 3-hydroxy-2-cyclo-alken-1-one derivatives, which process comprises cathodically reducing a compound of the formula

I

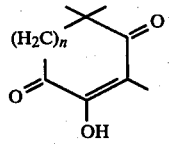

wherein n is the integer 0 or 1, to a compound of the formula

II

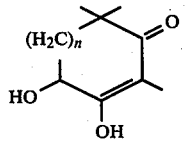

wherein n is, again, the integer 0 or 1.

2. A process for the manufacture of 3-hydroxy-2-cyclo-alkene-1-one derivatives which process comprises cathodically reducing a compound of the formula

II

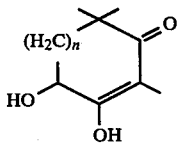

wherein n is the integer 0 or 1, in an acidic or neutral medium to a compound of the formula

III

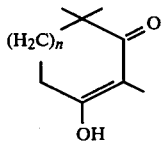

wherein n is, once again, the integer 0 or 1.

3. A process according to claim 2, wherein the reduction of the compound of formula II, in which n is the integer 0, is carried out with the addition of a phase transfer catalyst.

4. A process according to claim 1 wherein the reduction is carried out in a subdivided cell.

5. A process according to claim 2 wherein the reduction is carried out in a subdivided cell.

6. A process according to claim 3 wherein the reduction is carried out in a subdivided cell.

7. A process according to claims 1,2,3,4,5 or 6 wherein the reduction is carried out in an acidic reaction medium.

8. A process according to claim 7, wherein the reduction is carried out in a mixture of an aqueous mineral acid and an inert organic solvent.

9. A process according to claim 8, wherein sulfuric acid is used as the mineral acid.

10. A process according to claim 8 wherein methanol, ethanol, t-butanol, tetrahydrofuran or 1,4-dioxane is used as the inert organic solvent.

11. A process according to claim 9, wherein methanol, ethanol, t-butanol, tetrahydrofuran or 1,4-dioxane is used as the inert organic solvent.

12. A process according to claims 1,2,3,4,5 or 6 wherein lead, graphite or mercury is used as the cathode material.

13. A process according to claims 1,2,3,4,5 or 6 wherein the reduction is carried out in an acidic reaction medium and wherein lead, graphite or mercury is used as the cathode material.

14. A process according to claims 1,2,3,4,5 or 6 wherein the reduction is carried out in a mixture of an aqueous mineral acid and an inert organic solvent and wherein lead, graphite or mercury is used as the cathode material.

15. A process according to claim 14 wherein sulfuric acid is used as the mineral acid.

16. A process according to claim 14 wherein methanol, ethanol, t-butanol, tetrahydrofuran or 1,4-dioxane is used as the inert organic solvent.

17. A process according to claims 1,2,3,4,5 or 6 wherein the reduction is carried out at a temperature between room temperature and the boiling point of the reaction mixture.

* * * * *